United States Patent [19]

Moll

[11] Patent Number: 4,780,100

[45] Date of Patent: Oct. 25, 1988

[54] FABRIC CLEANER

[75] Inventor: Karl Moll, San Ramon, Calif.

[73] Assignee: The Clorox Company, Oakland, Calif.

[21] Appl. No.: 935,654

[22] Filed: Nov. 26, 1986

Related U.S. Application Data

[62] Division of Ser. No. 682,029, Dec. 14, 1984, Pat. No. 4,652,389.

[51] Int. Cl.[4] ..... B08B 7/00; B65D 83/14

[52] U.S. Cl. ..... 8/137; 222/635; 252/305

[58] Field of Search ..... 8/137; 252/90, 139, 252/173, DIG. 14, 162, 171, 305; 222/635

[56] References Cited

U.S. PATENT DOCUMENTS

| | | | |
|---|---|---|---|
| 3,131,153 | 4/1964 | Klausner | 252/305 |
| 3,431,060 | 3/1969 | Picklin | 8/137 |
| 3,541,581 | 11/1967 | Monson | 252/90 |
| 3,558,495 | 1/1971 | Mace | 252/90 |
| 3,723,330 | 3/1973 | Sheflin | 252/153 |
| 3,748,268 | 2/1973 | Loudas | 252/90 |
| 3,779,929 | 12/1973 | Abler et al. | 252/90 |
| 3,915,902 | 10/1975 | Ancel et al. | 252/526 |
| 3,919,101 | 11/1975 | Anstett et al. | 252/90 |
| 3,947,567 | 3/1976 | Berg et al. | 424/45 |
| 3,960,742 | 6/1976 | Leonard | 252/90 |
| 3,962,150 | 6/1976 | Viola | 252/542 |
| 3,970,584 | 7/1976 | Hart et al. | 252/305 |
| 3,997,467 | 12/1976 | Jederstrom | 252/305 |
| 4,085,059 | 4/1978 | Smith et al. | 252/118 |
| 4,188,447 | 2/1980 | Ehlenz | 428/310 |
| 4,216,104 | 8/1980 | Gergely | 252/91 |
| 4,219,333 | 8/1980 | Harris | 8/137 |
| 4,272,393 | 6/1981 | Gergely | 252/91 |
| 4,574,052 | 3/1986 | Gupte et al. | 252/90 |

FOREIGN PATENT DOCUMENTS 890567 3/1962 United Kingdom .

*Primary Examiner*—Prince E. Willis

*Attorney, Agent, or Firm*—Joel J. Hayashida; Stephen M. Westbrook; Michael J. Mazza

[57] ABSTRACT

The invention provides a carpet cleaning composition and dispensing means which use foam producing surfactants, solvents, propellants, builders and water. Other adjuncts may be added, such as fragrances, dyes, and fabric softeners.

The invention also provides a method for cleaning soiled fabrics having fibers containing soiling particles which comprises:

(a) applying to said fibers an aqueous, solvent/surfactant admixture having a solvent with consistent evaporation rate in ambient air;

(b) collapsing without abrasion said mixture into said fibers and emulsifying and segregating said soiling particles during a controlled residence time; and (c) evaporating said solvent so as to form said admixture into a foam, elevating said soiling particles substantially to the surface of said fibers; and compositions directed to the same.

12 Claims, 1 Drawing Sheet

FABRIC CLEANER

This is a division of application Ser. No. 682,029, filed Dec. 14, 1984, now U.S. Pat. No. 4,652,389.

BACKGROUND OF THE INVENTION

Present methods of cleaning carpets, and compositions appropriately suited therefor, include:

1. Aerosol Foams: Typical products are based on surfactant/solvent blends which, by means of gaseous propellants, blow into stuff, dry foams which adhere to the upper surface of carpet fibers but, owing to the relatively dry, high density foam, are incapable of independently penetrating the carpet fibers. Thus, these foams must be driven into carpet fabric piles with wet sponge or other type mops. Thereafter, in order to separate the soil from the carpet fabric, vigorous, and sometimes exhaustive, abrading of the carpet fibers with a brush must be accomplished.

Disadvantages of foam aerosols are apparent. Aside from sometimes arduous efforts required to drive such a cleaner into the carpet fabric, such aerosol foams actually remove relatively little soiling material from carpet fabric. Furthermore, if one seeks to improve the emulsifying effects of the foam aerosol by adding more water, either directly, or via the sponge mop, it appears the only results are the deleterious ones of thoroughly wetting the carpet backing, thus necessitating the need to dry out the carpet fibers over a longer period of time, and further driving the foam aerosol composition itself into the fibers. Whether this type of cleaner is used with water or not, a tacky residue may be left on the surface of the carpet fibers. This then promotes re-soiling of the carpet fibers. The result is that if such a carpet fabric surface is cleaned with aerosol foams, the more often it must be re-cleaned.

The only apparent advantage that foam aerosols have is that they are relatively inexpensive and require no special equipment. However, economic benefits of these cleaners are obviously severely mitigated due to the re-soiling phenomenon.

2. Rotary Brush Systems: This system usually requires professional machinery, generally speaking brushes mounted on a rotary drum which is driven by a motor housed in an upright, broom-like appliance. This system is actually nothing more than a more effective way of driving in a cleaner such as the aforementioned foam cleaners into carpet fabric piles. Because of the motor-driven action, this particular system is extremely wearing upon thick, pile and shag-type carpets. Many of the fibers are abraded out of the fabric of the carpet, and thus, upon drying, the carpet does not "fluff" as readily as before. Eventually, the life of the carpet may be decreased by the abrasive action of such cleaners. Further, previously expressed disadvantages of increased wetting, longer drying time and relatively inefficient cleaning, are lessened, but, in view of the cost, and special equipment that need to be used in this system, such system is not significantly better than cleaning with aerosol foams. Furthermore, even with the rotary brush system, there is significant re-soiling.

3. "Steam Extraction": Although nominally called a "steam extraction" system, this type of cleaner does not utilize steam, but rather pressurized, heated water in combination with surfactants and other cleaning agents. In practice, the surfactant and other agents are dissolved in a solution of hot water, then injected directly into the carpet fabric via a pressurized delivery system. The surfactants wet the carpet fabric pile, however, the hot water also aids in the penetration of the carpet fabric and in the emulsification of soiling agents and particles, as normally higher temperatures will cause an increase in surface wetting abilities of a given surfactant composition. After the surfactant solution has had sufficient time to emulsify and loosen soiling particles in the carpet fabric, it (and the water associated therewith) are physically removed from the carpet pile by means of the powerful vacuuming system generally available with this "steam extraction" system. Thus, problems of drying are generally avoided by the physical removal of the water and surfactant solution by the vacuum. However, unless the carpet is then "rinsed" with clear water solutions and re-vacuumed, resoiling may again occur because the carpet has a tacky residue.

The major, apparent disadvantages of such a "steam extraction" system are the expenses of renting the "steam extraction" system, and purchasing the chemicals needed therefor. Furthermore, it is inconvenient for the ordinary consumer to have to go to the local supermarket or hardware store to obtain these items.

Professional cleaners may utilize either this system or the prior, rotary brush system. By using professional cleaners, even more expense is added.

DISCLOSURE OF THE INVENTION

The newly-discovered invention provides a composition for cleaning fabrics, which comprises:

(a) approximately 0.1% to 30.0% be weight of a foam forming surfactant;

(b) approximately 0.5% to 20.0% by weight of a volatile organic solvent having a consistent evaporation rate in ambient air;

(c) approximately 3.0% to 50.0% by weight of a propellant;

(d) approximately 0.5% to 20.0% by weight of a builder; and (e) the remainder as water.

Further, the newly-discovered invention relates to a method for cleaning soiled fabrics having fibers containing soiling particles, comprising:

(a) applying to said fibers an aqueous, solvent/surfactant admixture, said solvent having a consistent evaporation rate in ambient air and said surfactant being foam forming;

(b) collapsing without abrasion said admixture into said fibers and emulsifying and segregating said soiling particles during a controlled residence time;

(c) evaporating said solvent so as to form said admixture into a foam, elevating said soiling particles substantially to the surface of said fibers.

In yet another aspect of the invention is provided a dispenser for a fabric cleaner, said dispenser comprising:

dispensing means containing an aqueous, solvent/surfactant admixture, said solvent having a consistent evaporation rate in ambient air and said surfactant being foam forming;

said dispensing means delivering under pressure said solvent/surfactant admixture onto a fabric surface, whereupon said solvent/surfactant admixture forms an initial foam, then collapses without abrasion during a controlled residence time; and said solvent in said admixture evaporating, causing a second foam to form and rise up through said fabric surface.

DETAILED DESCRIPTION OF THE INVENTION

Figure 1:
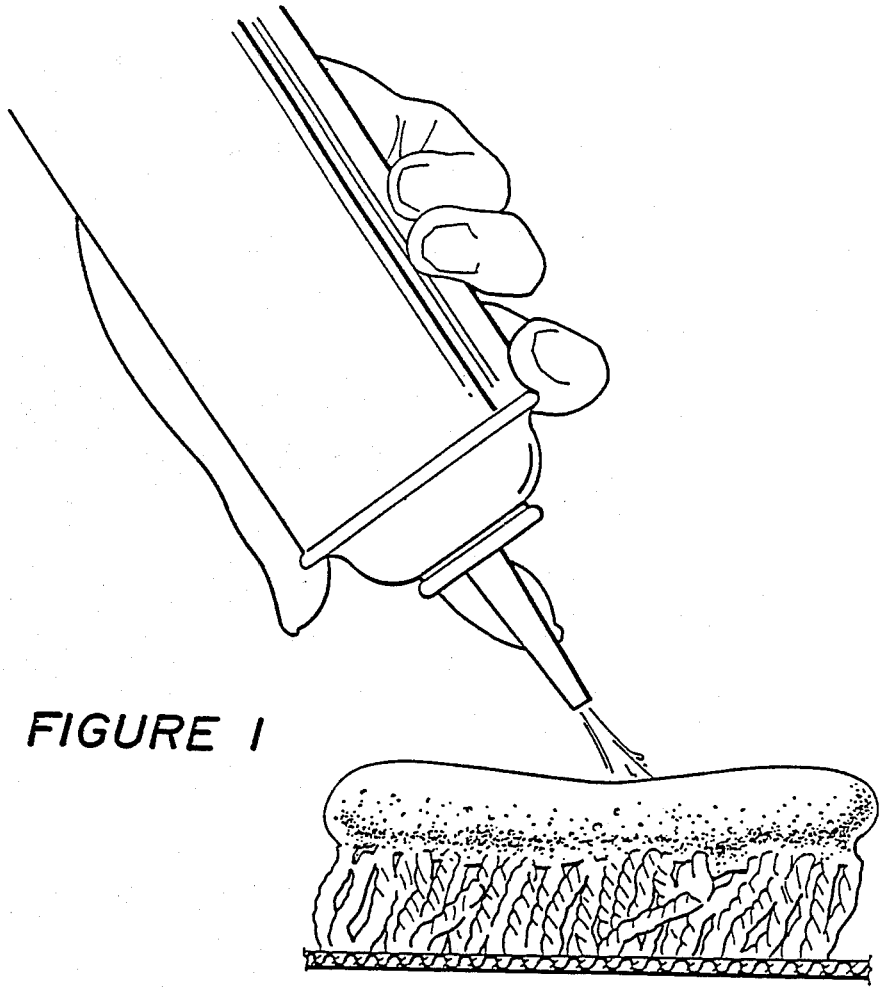
FIG. 1 depicts the dispensing of the cleaner of the invention from a pressurized dispenser as a rather porous, quickly collapsing foam.

The disadvantages of the present carpet cleaning methods and compositions used therein have been previously described at length. The instant invention surprisingly appears to address and remedy substantially nearly all of the heretofore mentioned disadvantages.

In addressing initially the cleaning problems experienced with the prior art cleaners, especially, aerosol foams, and rotary brush systems, it was discovered that not only was penetration of the carpet fabric and emulsification of the soils lodged therein problematic, but also sufficiently loosening such soiling particles so that they could be vacuumed up along with the surfactant used via an ordinary carpet vacuum cleaner. Generally, although some soil could be loosened from the carpet fabric, it will only be that superficial soil near to the surface of the carpet fabric.

It was postulated that a peroper solvent/surfactant admixture which could penetrate the fibers and emulsifying the soiling particles lodged therein would solve the problem if the thus dislodged soiling particles and the solvent/surfactant admixture could be made to rise to the surface of the carpet fibers where it could be easily picked up by vacuum cleaners, brooms, etc.

It was proposed that in said solvent/surfactant admixture, a solvent be included which had a consistent evaporation rate.

The solvent of concern should be a volatile organic solvent which, after being dispensed, will volatilize. Suprisingly, due to volatilization of the solvent, the solvent's vapor pressure causes the fabric cleaner of this invention to "blow" into a foam, carrying the solvent-/surfactant admixture and the emulsified soiling particles substantially to the surface of the carpet fibers.

It is important that the evaporation rate of this organic, volatile solvent be consistent, but delayed long enough so that the surfactant has suitable time to penetrate the carpet fabric and emulsify the soiling particles lodged therein. This is called controlled residence time. Finally, after this controlled residence time period, a seconary re-foaming occurs during a consistent blow-up time. This further novel aspect of the invention, the consistent blow-up or reforming time, is the time from initial application of the cleaner until the time a secondary foam rises and attains equilibrium at the carpet surface.

Surprisingly, it has been found that unlike the physical abrasion methods of foam aerosols and rotary brush systems, no brushing in or other means of physically driving this solvent/surfactant admixture into carpet fabric pile is needed. In fact, it may be disadvantageous to physically drive the admixture of the invention into carpet fabric piles. It is speculated that brushing in the solvent/surfactant admixture may hinder its re-foaming capacity because more rapid volatilization of the solvent is promoted, or the solvent is physically separated from the solvent/surfactant admixture. This theory is for the purposes of explanation and not meant to restrict the scope of embodiments of this invention.

1. Surfactants

A substantial number of diverse, non-analogous surfactants may be utilized in this invention. For example, nonionic, anionic, cationic and amphoteric surfactants may be used in the present invention. The only requirement for the particular surfactant chosen is that it must form a foam. Therefore, those skilled in the art would known that certain surfactants, particularly those having defoaming properties, would not be suitable for use in this invention.

Examples of suitable nonionic surfactants may include polyoxyethylenes, polyoxypropylenes; alkylpolyoxyethylenes; alkylarylpolyoxyethylenes; ethoxylated alkylphenols; carboxylic acid esters such as glycerol esters of fatty acids, certain polyethylene glycol esters, anhydrosorbitol esters, ethoxylated anhydrosorbital esters, ethylene and methylene glycol esters, propanediol esters, and ethoxylated natural fats and oils (e.g. tall oil, linseed oils, coco oils, etc.); carboxylic amides such as 1:1 amine acid diethanolamine condensates, 2:1 amine/acid diethanolamide condensates, and monoalkanolamine condensates such as ethanolamine condensates, and isopropanol-amine condensates; polyoxyethylene fatty acid amides; certain polyalkylene oxide block co-polymers such as polyoxypropylene-polyoxyethylene block co-polymers; and other miscellaneous nonionic surfactants such as organosilicones.

Suitable anionic surfactants may include anionic aminocarboxylates, such as N-acyl-sarcosinates, alkyl, alkoyl, and alkylol sarcosinates, and acylated protein hydrolysates; sulfonates such as alkyl, alkyl aryl—(e.g., alkyl benzenesulfonates), whether branched, or linear (e.g., "LAS," or linear dodecylbenzene sulfonate), alkoyl-, or alkylolsulfonates, N-acyl-N-alkoyltaurates, sulfoethyl esters of fatty acids, and alpha-olefin sulfonates; sulfates such as alkyl, alkylaryl, alkoyl, and alkylol sulfates, sulfates of natural fats and oils (e.g., castor, coconut, tallow oils), sulfated diunsaturated fatty acids, sulfated alkanolamides, sulfated esters, ethoxylated and sulfated alkylphenols, ethoxylated and sulfated alcohols (also known as alkyl ether sulfates); and phosphate esters, which are generally phosphorylated nonionics such as ethoxylated alcohols, ethoxylated alkylphenols, and polyoxythylene-polyoxypropylene block copolymers.

Particularly preferred anionic surfactacts used in this invention are alkyl sarcosinates and alkyl ether sulfates, or combinations thereof. It is not generally understood why these particular surfactants have been found so effective, but the interaction between the solvents and these surfactants results in optimal foaming, collapse and refoaming in the practice of the invention. Commercially available alkyl ether sulfates include those sold by Alcolac Chemical Company under the trademark Sipon ES. Alkyl sarcosinates are manufactured by, among others, W. R. Grace & Co., Hampshire Chemical Division using the trademark Hamposyl.

Suitable cationic surfactants may include a wide range of classes of compounds, including non-oxygen-containing alkyl mono-, di and polyamines, and resin derived amines; oxygen-containing amines, such as amine oxides (which appear to act as cationics in acidic solutions, and as nonionics in neutral or alkaline solutions); polyoxyethylene alkyl and alicyclic amines; substituted alkyl, alkylol imidazolines, such as 2-alkyl-1-

(hydroxyethyl)-2-imidazolines; amide linked amines, and quaternary ammonium salts ("quats").

Further, possibly appropriate, amphoteric surfactants containing both acidic and basic hydrophilic moieties in their structure, may include alkyl betaines, amino carboxylic acids and salts thereof, amino-carboxylic acid esters, and others. Further surfactants may be selected from those disclosed in Kirk-Othmer, *Encyclopedia of Chemical Technology*, Third Ed., Vol. 22, pp. 347–387, and *McCutcheon's Detergents and Emulsifiers*, North American Ed., 1983, which are incorporated herein by reference.

It is preferred to use a range of about 0.1 to 30.0%, more preferably 0.1 to 25.0%, and most preferably 0.1 to 10.0% surfactant in the formulas of this invention. These ranges are preferred to achieve optional cleaning, foaming and refoaming characteristics.

2. Solvents

As herein before mentioned, the solvents of the invention include any suitable, volatile, organic solvent with a consistent evaporation rate, thereby providing the required controlled residence time, and blow-up or refoaming time of this invention. These organic, volatile solvents may include saturated alkanes of 1 to 12 carbons, preferably 2 to 8 carbon atoms, one example of which is hexane. Other solvents which are appropriate for use are substituted alkanes, such as the halogenated alkanes, such as the chlorofluorohydrocarbons commonly sold under the trademark Freon, by E. I. du Pont de Nemours, carbon tetrachloride, and perchloroethylene mixtures of alkanes, and substituted alkanes, and mixtures of any of the foregoing are also included in the present invention.

Further, the preferred solvents of this invention appear to fit certain characteristics. For example, as shown in TABLE I below, preferred solvents appear to have temperatures of no more than about 100° at 100 mm of mercury, and no more than about 175° C. at 760 mm of mercury, as defined in the *Handbook of Chemistry and Physics:*

TABLE I

Temperatures at Which 100 mm & 760 mm Pressures Exist

| Solvent | °C. at 100 mm | °C. at 760 mm |
|---|---|---|
| Hexane | 16 | 69 |
| Chloroform | 10 | 61 |
| Trichloro methyl Silane | 12 | 66 |
| Methanol | 21 | 65 |
| Acetonitrile | 27 | 82 |
| 1-2 dichloroethane | 29 | 82 |
| 1,1 Dichloroethane | 17 | 57 |
| Acrylonitrile | 23 | 79 |
| Methyl acetate | 9 | 58 |
| Ethyl Formate | 5 | 54 |
| Bromopropane | 18 | 71 |
| 1-Propane Thiol | 15 | 67 |
| Propyl Amine | 0.5 | 48 |
| Isopropyl Formate | 18 | 68 |
| Sec/Iso Butyl chloride | 14 | 68 |
| Diethyl, difluorosilane | 10 | 58 |
| Isobutyl amine | 19 | 69 |
| Tetramethyl-di-Borane | 15 | 69 |
| Methyl cyclopentane | 18 | 72 |
| 2-or 3-Methyl pentane | 18(8) | 72(60) |
| Diisopropyl ether | 14 | 68 |
| Pentane | −13 | 36 |
| Hexane | 16 | 69 |
| Heptane | 42 | 98 |
| Octane | 66 | 126 |
| Nonane | 88 | 151 |
| Decane | 109 | 174 |
| Undecane | 128 | 196 |

TABLE I-continued

Temperatures at Which 100 mm & 760 mm Pressures Exist

| Solvent | °C. at 100 mm | °C. at 760 mm |
|---|---|---|
| Dodecane | 146 | 216 |
| Tridecane | 163 | 234 |
| Tetradecane | 179 | 253 |
| Pentadecane | 194 | 271 |
| Hexadecane | 209 | 288 |
| Heptadecane | 223 | 303 |
| Octadecane | 236 | 317 |
| Nonadecane | 248 | 330 |
| 1, 1, 1, Trichloroethane | 20 | 74 |
| Trichloroethylene | 31 | 87 |

3. Propellants

In order to deliver and build the first foam for use in this particular embodiment of the invention, it is preferable to deliver the solvent/surfactant admixture via a gaseous propellant. Additionally, it appears that the propellant, which of necessity is itself a solvent, interacts with the solvents used in the invention to cause the necessary action to promote initial foam formation, collapse and refoaming. Such propellant could be, but need not be, a hydrocarbon, of from 1 to 10 carbon atoms, such as methane, ethane, n-propane, n-butane, isobutane, n-pentane, or isopentane and mixtures thereof. The propellant may also be selected from halogenated hydrocarbons including, but not limited to fluorocarbons, chlorocarbons, chlorofluorocarbons, and mixtures thereof. Still further propellants include halogenated alkenes, for example vinyl chloride and vinyl fluoride; and dimethyl ether. Some of these latter examples are quickly flammable and may need to be combined with another gas, eg. $CCl_2F_2$, to bring them into a non-flammable state. These exemplary gases belong generally to the group of compounds called liquefiable gases.

However, for this particular embodiment of the invention, the propellant to be used is not restricted to these particular gases. Various compressed (non-liquefiable) gases which are applicable for use include nitrious oxide, nitrogen, carbon dioxide, and inert, Noble gases, such as helium and neon.

Although pressure within the dispenser, i.e., can pressure, does not appear to be critical, a preferred range of about 5 to 130 lbs./in$^2$, more preferably 10 to 130 lbs./in$^2$, and most preferably 50 to 130 lbs./in$^2$. The amount of propellant is adjusted to take into consideration the effects of added solvent, homogeneity of the ingredients, dispenser size, etc. Other exemplary propellants are depicted in M. A. Johnson, *The Aerosol Handbook*, 1st Ed., (Wayne E. Dorland co.) (1972), pages 270, 276–77, 282, 321, 324, 329, and 344–45, the description of which is incorporated herein by reference.

4. Builders

The surfactant/solvent admixture of the present invention may also include at least one builder. Such a builder would tend to promote the emulsification of the surfactant into the foam phase. Examples of such builders include those of alkaline nature (pH 7.0+), such as potassium silicate, commonly sold under the trademark Kasil by PQ Corporation, soda ash (sodium carbonate), and other alkali metal salts of silicates, phosphates, and carbonates. Other builders such as ethylene diaminetetraacetate (EDTA), nitrilotriacetic acid (NTA) and organic builders such as the alkali metal salts of sulfosuccinates, succinates, acetates and maleates. The types of builders used are not limited but they should be substantially water soluble or dispersible. Materials which are not soluble may have deleterious effect on both dispensing and cleaning properties of the invention. It is for this particular reason that abrasive materials, such as silica sand, perlite and the like are avoided in the invention.

It has been found that the following ranges of the solvent/aqueous surfactant/propellant admixture may be preferred:

0.1% to 10.0% by weight of (100%) surfactant;*
0.1% to 70.0% by weight of volatile organic solvent;
1.0% to 30.0% by weight of the propellant;
preferably, 0.0% to 20.0% by weight of the builder; and
the remainder as water.

*Those skilled in the art know that many commercial surfactants, such as anionic surfactants, are typically sold as aqueous solutions containing certain percentages of active (i.e., 100%) surfactant.

In further embodiments of this invention, 0.5% to 10.0% of cleaning adjuvants may be added, selected from such adjuvants as dyes, fragrances and antimicrobially active agents, such as the substituted phenols sold by Dow Chemical Company under the trademark Dowicide, and by Monsanto Chemical Company under the trademark Santophen, and fabric softeners, such as quaternary ammonium compounds, e.g., such as those sold by Lonza Chemical Company under the trademark Bardac (these types of quaternary ammonium surfactants apparently also may act as germicidal agents).

Dispenser

In yet another embodiment of the invention, a dispenser is provided to deliver the fabric cleaners. As a means of delivering the novel compositions of this invention, a typical pressurized dispensing means comprises:

a closed container, propellant and solvent/surfactant admixture-containing chamber and dispensing head, said dispensing means containing an aqueous solvent-/surfactant admixture, said solvent having a consistent evaporation rate in ambient air and said surfactant being foam-forming, said dispensing means delivering under pressure said solvent/surfactant admixture onto a fabric surface, whereupon said solvent/surfactant admixture forms an initial foam, then collapses without abrasion during a controlled residence time, and said solvent in said mixture thereafter evaporating, causing a second foam to form and rise through said fabric surface.

Figure 2:
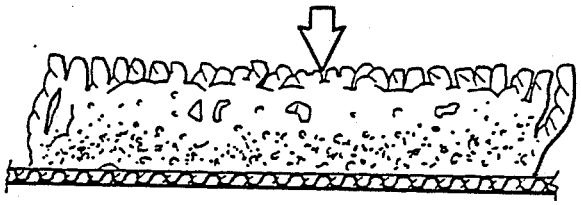
FIG. 2 depicts the foam immediately after collapse.
Figure 3:
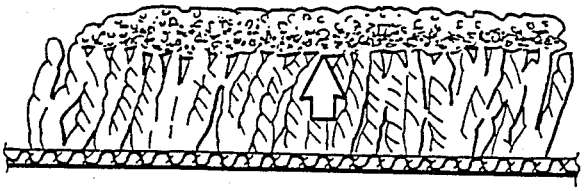
FIG. 3 depicts the formation of a secondary foam rise.

By referring to the drawings, this dispensing means is most aptly illustrated in action, delivering the composition. FIGS. 1, 2 and 3 show in sequence (1) the delivery of the composition, which breaks into an initial foam; (2) the collapse of the initial foam into the selected fabric surface; and (3) the formation of the secondary foam after a controlled residence period.

Although again, it is not precisely understood why the invention performs in the manner shown, it is speculated that the propellant, which is a volatile organic solvent itself, may volatilize, rapidly leaving the foam. This may cause the foam to "break" or collapse for reasons of lessened surface tension. Alternatively, it is possible that with the propellant having left, the solvent itself may temporarily act as a "defoamer." Next, the solvent, which may be somewhat less volatile than the propellant, appears to volatilize, causing the secondary foam rise or "blow." Reasons for this secondary foam rise are also speculative.

This best mode depiction of the invention can be accomplished by adapting many prior art dispensers and by means known to those skilled in the art. For example, prototypical dispensers are disclosed in Monson, U.S. Pat. No. 3,541,581, column 10, lines 55–75, column 11, lines 1–75 and column 12, lines 1–64, which are incorporated herein by reference. Unlike the materials therein disclosed, namely post-foaming gels, applicant does not require isolation of his compositions from the aerosol delivery systems. In fact, applicant believes that there is a cooperative interaction between the solvent/surfactant admixture and the propellants used which result in the unusual first foam/collapse/second foam characteristics of the invention.

The following EXAMPLE I exemplifies one preferred embodiment of the compositions of this invention:

EXAMPLE 1

| Ingredient | Weight % |
|---|---|
| Sipon ES (75% $H_2O$; 25% sodium lauryl ether sulfate) | 4.0 |
| KaSil #1 (potassium silicate) | 6.0 |
| Hexane (Solvent) | 26.0 |
| Propellant A-70 (hydrocarbon mix) | 20.0 |
| Water | 44.0 |
| TOTAL | 100.0 |

Use of this formula embodied in EXAMPLE I proved a fair representative of the first foam forming, collapsing, and second foam blowing admixture of this invention.

A further example depicting the ranges of the preferred carpet cleaner compositions follows:

EXAMPLE 2

| Component | | Ranges |
|---|---|---|
| Hamposyl | (sodium alkyl sarcosinate) 75.0% water; 25.0%) | 0.0–3.0% |
| Sipon ES | (Sodium lauryl ether sulfate) | 2.0–12.0% |
| KaSil #1 | (potassium silicate) | 0.0–8.0% |
| Hexane | (solvent) | 1.0–35.0% |
| A-70 Propellant | (hydrocarbon mix) | 5.0–20.0% |
| Water | | 92.0–22.0% |

In the examples 3–48 in TABLE II, combinations of the following preferred ranges of components comprising embodiments of the invention are set out:

TABLE II

| | % | | | | | | |
|---|---|---|---|---|---|---|---|
| EXAMPLES: | HAMPOSYL[1] | SIPON ES[2] | KASIL #1[3] | HEXANE | A70 PROP[4] | WATER | % SR[5] |
| 3 | 0.0 | 2.0 | 0.0 | 10.0 | 5.0 | 83.0 | −133.23 |
| 4 | 0.0 | 2.0 | 0.0 | 10.0 | 20.0 | 68.0 | −40.01 |
| 5 | 0.0 | 2.0 | 0.0 | 35.0 | 5.0 | 58.0 | −69.02 |
| 6 | 0.0 | 2.0 | 0.0 | 35.0 | 20.0 | 43.0 | −43.26 |
| 7 | 0.0 | 2.0 | 8.0 | 10.0 | 5.0 | 75.0 | 49.58 |

TABLE II-continued

| EXAMPLES: | HAMPOSYL[1] | SIPON ES[2] | KASIL #1[3] | HEXANE | A70 PROP[4] | WATER | % SR[5] |
|---|---|---|---|---|---|---|---|
| | % | | | | | | |
| 8 | 0.0 | 2.0 | 8.0 | 10.0 | 20.0 | 60.0 | 31.18 |
| 9 | 0.0 | 2.0 | 8.0 | 35.0 | 5.0 | 50.0 | 40.92 |
| 10 | 0.0 | 2.0 | 8.0 | 35.0 | 20.0 | 35.0 | 15.61 |
| 11 | 0.0 | 12.0 | 0.0 | 10.0 | 5.0 | 73.0 | −52.21 |
| 12 | 0.0 | 12.0 | 0.0 | 10.0 | 20.0 | 58.0 | −54.08 |
| 13 | 0.0 | 12.0 | 0.0 | 35.0 | 5.0 | 48.0 | −36.56 |
| 14 | 0.0 | 12.0 | 0.0 | 35.0 | 20.0 | 33.0 | −39.77 |
| 15 | 0.0 | 12.0 | 8.0 | 10.0 | 5.0 | 65.0 | 26.93 |
| 16 | 0.0 | 12.0 | 8.0 | 10.0 | 20.0 | 50.0 | 7.77 |
| 17 | 0.0 | 12.0 | 8.0 | 35.0 | 5.0 | 40.0 | −10.60 |
| 18 | 0.0 | 12.0 | 8.0 | 35.0 | 20.0 | 25.0 | 9.13 |
| 19 | 3.0 | 2.0 | 0.0 | 10.0 | 5.0 | 80.0 | −105.59 |
| 20 | 3.0 | 2.0 | 0.0 | 10.0 | 20.0 | 65.0 | −165.61 |
| 21 | 3.0 | 2.0 | 0.0 | 35.0 | 5.0 | 55.0 | −116.07 |
| 22 | 3.0 | 2.0 | 0.0 | 35.0 | 20.0 | 40.0 | −164.43 |
| 23 | 3.0 | 2.0 | 8.0 | 10.0 | 5.0 | 72.0 | 13.02 |
| 24 | 3.0 | 2.0 | 8.0 | 10.0 | 20.0 | 57.0 | 15.23 |
| 25 | 3.0 | 2.0 | 8.0 | 35.0 | 5.0 | 47.0 | 69.95 |
| 26 | 3.0 | 2.0 | 8.0 | 35.0 | 20.0 | 32.0 | 4.54 |
| 27 | 3.0 | 12.0 | 0.0 | 10.0 | 5.0 | 70.0 | −91.78 |
| 28 | 3.0 | 12.0 | 0.0 | 10.0 | 20.0 | 55.0 | −103.21 |
| 29 | 3.0 | 12.0 | 0.0 | 35.0 | 5.0 | 45.0 | 39.89 |
| 30 | 3.0 | 12.0 | 0.0 | 35.0 | 20.0 | 30.0 | −80.62 |
| 31 | 3.0 | 12.0 | 8.0 | 10.0 | 5.0 | 62.0 | −32.65 |
| 32 | 3.0 | 12.0 | 8.0 | 10.0 | 20.0 | 47.0 | 28.39 |
| 33 | 3.0 | 12.0 | 8.0 | 35.0 | 5.0 | 37.0 | 39.21 |
| 34 | 3.0 | 12.0 | 8.0 | 35.0 | 20.0 | 22.0 | 11.35 |
| 35 | 0.0 | 7.0 | 4.0 | 22.5 | 12.5 | 54.0 | 19.78 |
| 36 | 3.0 | 7.0 | 4.0 | 22.5 | 12.5 | 51.0 | 1.14 |
| 37 | 1.5 | 2.0 | 4.0 | 22.5 | 12.5 | 57.5 | 30.49 |
| 38 | 1.5 | 12.0 | 4.0 | 22.5 | 12.5 | 47.5 | −34.21 |
| 39 | 1.5 | 7.0 | 0.0 | 22.5 | 12.5 | 56.5 | −101.65 |
| 40 | 1.5 | 7.0 | 8.0 | 22.5 | 12.5 | 48.5 | −4.95 |
| 41 | 1.5 | 7.0 | 4.0 | 10.0 | 12.5 | 65.0 | −40.46 |
| 42 | 1.5 | 7.0 | 4.0 | 35.0 | 12.5 | 40.0 | −16.92 |
| 43 | 1.5 | 7.0 | 4.0 | 22.5 | 5.0 | 60.0 | −2.42 |
| 44 | 1.5 | 7.0 | 4.0 | 22.5 | 20.0 | 45.0 | −24.81 |
| 45 | 1.5 | 7.0 | 4.0 | 22.5 | 12.5 | 52.5 | −32.04 |
| 46 | 1.5 | 7.0 | 4.0 | 22.5 | 12.5 | 52.5 | −14.26 |
| 47 | 1.5 | 7.0 | 4.0 | 22.5 | 12.5 | 52.5 | −5.97 |

[1]Hamposyl is W. R. Grace & Company, Hampshire Chemical Division's trademark for sodium alkyl sarcosinate
[2]Sipon ES is Alcolac Chemical Corporation's trademark for sodium lauryl ether sulfate.
[3]KaSil is PQ's trademark for potassium silicate, a builder.
[4]A-70 propellant is a mixture of three hydrocarbons: isobutane, propane and butane, with an average vapor pressure of 72 psig.
[5]SR is % Soil Removal, determined according to the soiling tests in TEST I, below.

TEST I

Carpet Soiling and Comparative Cleaning Methodology

A. Cleaning Comparison Study

Swatches of test carpet measuring 15.7 cm×12.6 cm were cut from Karastan Monticello "Opalite" (an off-white, polyester carpet). All were aligned with the nap going from top to bottom. Three replicates were used for all tests.

Soiling and Resoiling Procedure

Swatches were placed in a clean 15 centimeter ("cm")×21.5 cm Norton ceramic ball-mill jar with 45 2 cm×2 cm balls; 0.2000±0.0002 gram ("g") of a modified Sanders & Lambert soil (see below) was added to the jar. The jar was set on a roller-type tumbler for 15 minutes. The jar's orientation was reversed, and tumbled for an additional 15 minutes. The swatch was removed from the jar, and vacuumed in the direction of the nap four passes with a Eureka Model S Two-Speed Cordaway vacuum cleaner.

Resoiled swatches were rehumidified in a 37.5° C., 90–95% relative humidity room for two hours. These were them removed, and allowed to re-equilibrate to ambient conditions for approximately one-half hour. The swatches were then soiled using the procedure described above.

The performance of WOOLITE (trademark of American Home Products Corp.) and the invention of this application were compared in three different tests, consisting of six swatches each (three per treatment). In the first test, unsoiled swatches were treated five times. Another test used carpet soiled once and subsequently given five treatments. The third test used carpet subjected to five complete cycles of soiling and cleaning. Swatches were soiled into 0.20 g of a modified Sanders & Lambert soil formulation.

Modified Sanders & Lambert Soil Formulation

| | |
|---|---|
| Portland Cement | 27.7% |
| Silica, 200 mesh | 27.7% |
| Bandy Black Clay | 29.3% |
| Decolorizing Carbon | 1.5% |
| Ferric Oxide | 0.3% |
| Stearic Acid | 1.5% |
| Oleic Acid | 1.5% |
| Palm Oil | 3.0% |
| Cholesterol | 1.0% |
| Squalene | 1.0% |
| Octadecane | 1.0% |
| Octadecene | 1.0% |
| Linoleic Acid | 2.0% |
| Paraffin Oil | 1.5% |

-continued

| | |
|---|---|
| | 100.0% |

100 grams of soil were prepared for this test. 150 grams of deionized water were added to the mixture. All ingredients were mixed in a Norton ceramic ball mill containing 50 balls for 2 hours. The mixture was removed from the ball mill and dried overnight. The soil was returned to a clean ball mill, and tumbled again for 2 hours. The soil was ground and sieved in a No. 3-sieve.

Only one aerosol can of either the invention or WOOLITE was used throughout the experiment. After cleaning, the swatches were vacuumed six passes with a Eureka Model S two-speed Cordaway, and then instrumentally graded on a Gardner XL031 colorimeter.

B. Colorimetric Analysis

Color reflectance data was obtained from all swatches after each treatment and vacuuming. The most important reflectance parameter in this study is the degree of lightness (L). Readings taken after soiling ($L_s$) or cleaning ($L_w$) are compared with that of an untreated swatch ($L_o$). Changes in L-values represent the amount of soil deposited or removed after treatment, and are reported in TABLES II and III as % Soil Removed (S.R.).

Swatches were read on a Gardner XL-31 colorimeter that was connected to a Hewlett-Packard 9815A calculator/printer. The YXZ, large beam was used. Five sequential readings were taken in a 5 cm×5 cm square in the center of each swatch.

TEST II

Flammability Tests current laboratory standards, ignition 12 inches from the center of the flame is acceptable. Ignition from 18 inches, however, may indicate unacceptable flammability.

2. Flash Point Determination: Flash point is defined as the lowest temperature at which the vapors emanating from a combustible substance will ignite when exposed to a small flame. Among the various methods used are: closed-up, open-cup, tag closed-cup, tag open-cup, and Cleveland open cup methods, all of which are known to practitioners skilled in this art.

3. Closed Drum Test: A 55 gallon drum, or other suitable container, is fitted with a hinged lid. A source of ignition is placed on the bottom floor of the container. The combustible substance is introduced, usually by spraying into the container.

4. Tower Test: A long graduated cylinder with apertures at 1 inch intervals running along its length, is set up. Pieces of masking tape cover reach aperture. Some of the combustible substance to be tested is introduced into the bottom of the cylinder. To test degree of flammability, the pieces of tape are pulled off the apertures, beginning from the top, and the uncovered aperture is exposed to a flame to test ignition. The height at which ignition occurs is recorded.

5. Trough Test: The combustible substance is introduced into a very narrow trough and ignited. If flame burns the length of the trough, the substance is deemed flammable.

In TABLE III, below, examples 50–76 show the % soil removal in accordance with the methodology of TEST I and flammability in accordance with TEST II, above.

In this particular series, the "Tower Test" was used to test flammability.

TABLE III

| | | | Soil Removal and Flammability | | | | |
|---|---|---|---|---|---|---|---|
| Example | SIPON ES | KASIL #1 | HEXANE | A-70 PROP. | WATER | % SOIL REMVL | FLAMMABILITY |
| 48 | 0.0 | 6.0 | 5.0 | 5.0 | 84.0 | 15.7 | 3.5 |
| 49 | 0.0 | 6.0 | 5.0 | 20.0 | 69.0 | 20.0 | 1.5 |
| 50 | 0.0 | 6.0 | 25.0 | 5.0 | 64.0 | −1.6 | 1.0 |
| 51 | 0.0 | 6.0 | 25.0 | 20.0 | 49.0 | 19.4 | 0.0 |
| 52 | 0.0 | 10.0 | 5.0 | 5.0 | 80.0 | 4.4 | 0.0 |
| 53 | 0.0 | 10.0 | 5.0 | 20.0 | 65.0 | 9.8 | 1.0 |
| 54 | 0.0 | 10.0 | 25.0 | 5.0 | 60.0 | 14.6 | 1.0 |
| 55 | 0.0 | 10.0 | 25.0 | 20.0 | 45.0 | 9.1 | 2.0 |
| 56 | 4.0 | 6.0 | 5.0 | 5.0 | 80.0 | 48.8 | 1.5 |
| 57 | 4.0 | 6.0 | 5.0 | 20.0 | 65.0 | 32.3 | 5.5 |
| 58 | 4.0 | 6.0 | 25.0 | 5.0 | 60.0 | 43.3 | 4.5 |
| 59 | 4.0 | 6.0 | 25.0 | 20.0 | 45.0 | 45.2 | 7.5 |
| 60 | 4.0 | 10.0 | 5.0 | 5.0 | 76.0 | 45.6 | 4.0 |
| 61 | 4.0 | 10.0 | 5.0 | 20.0 | 61.0 | 44.9 | 5.0 |
| 62 | 4.0 | 10.0 | 25.0 | 5.0 | 56.0 | 57.9 | 5.0 |
| 63 | 4.0 | 10.0 | 25.0 | 20.0 | 41.0 | 64.2 | 7.5 |
| 64 | 0.0 | 8.0 | 15.0 | 12.5 | 64.5 | 13.4 | 2.5 |
| 65 | 4.0 | 8.0 | 15.0 | 12.5 | 60.5 | 48.0 | 7.5 |
| 66 | 2.0 | 6.0 | 15.0 | 12.5 | 64.5 | 46.9 | 5.0 |
| 67 | 2.0 | 10.0 | 15.0 | 12.5 | 60.5 | 60.6 | 7.0 |
| 68 | 2.0 | 8.0 | 5.0 | 12.5 | 72.5 | 52.5 | 5.0 |
| 69 | 2.0 | 8.0 | 25.0 | 12.5 | 52.5 | 44.0 | 5.5 |
| 70 | 2.0 | 8.0 | 15.0 | 5.0 | 70.0 | 56.7 | 2.0 |
| 71 | 2.0 | 8.0 | 15.0 | 20.0 | 55.0 | 52.6 | 5.0 |
| 72 | 2.0 | 8.0 | 15.0 | 12.5 | 62.5 | 48.4 | 5.5 |
| 73 | 2.0 | 8.0 | 15.0 | 12.5 | 62.5 | 52.2 | 6.5 |
| 74 | 2.0 | 8.0 | 15.0 | 12.5 | 62.5 | 47.0 | 5.5 |

Flammability may be tested by any one or more of five representative methods:

1. Flame Projection: An open flame is placed in the middle of a laboratory table. A straight edge rule is centered with respect to the flame tip. The composition to be tested is sprayed towards the open flame. Under Table IV below shows in detail numerous examples in which the method of this invention was practiced. In this methodology, formulations as shown in Examples 48–74 of Table IV, were initially applied from aerosol containers onto a strip of Karastan "Emperor" Forest Palm carpet. All formulations were dispensed in a 5 minute burst to ensure uniformity in data. Two trials were performed for each formulation.

After initial application, time for foam collapse was recorded, and height of the initial and collapsed foam column was recorded additionally, penetration of collapsed foam into the carpet strip was measured.

Then, the start (collapse), and finish (Development of Full Blow) of the secondary foam blow was recorded, as well as the edge width and final height of the secondary foam.

The "controlled residence time phase" alluded to earlier is determined as the difference between the collapse time and the full blow time. The significance of this controlled residence time phase is that this is when the cleaning composition has substantially penetrated below the surface of the carpet, and causes soiling materials adhering to the carpet fibers to become segregated and emulsified. When the secondary foam rise commences, these soiling particles are believed to be carried to the surface of the carpet fibers along with the secondary foam rise. Therefore, this controlled residence time is particularly significant, and as empirically determined, should last at least 1 minute, and ranges upward to about 1 hour's time. Preferably, this controlled residence time is from 2–30 minutes, more preferably 2–20 minutes.

TABLE IV

| Examples | Application Time (sec) | Collapse (min) | Post-Collapse Foam-Height (min) | Development of blow (min) | Full Blow Time (min) | Lifetime (min) | Penetration | Edge Width (mm) | Full Blow (mm) | Initial Height (mm) |
|---|---|---|---|---|---|---|---|---|---|---|
| 48 | 5 | — | 0 | — | — | — | complete | — | — | 0 |
| | 5 | — | 0 | — | — | — | complete | — | — | 0 |
| 49 | 5 | — | 0 | — | — | — | complete | — | — | 0 |
| | 5 | — | 0 | — | — | — | complete | — | — | 0 |
| 50 | 5 | — | 0 | — | — | — | complete | — | — | 0 |
| | 5 | — | 0 | — | — | — | complete | — | — | 0 |
| 51 | 5 | — | 0 | — | — | — | complete | — | — | 0 |
| | 5 | — | 0 | — | — | — | complete | — | — | 0 |
| 52 | 5 | — | 0 | — | — | — | complete | — | — | 0 |
| | 5 | — | 0 | — | — | — | complete | — | — | 0 |
| 53 | 5 | — | 0 | — | — | — | complete | — | — | 0 |
| | 5 | — | 0 | — | — | — | complete | — | — | 0 |
| 54 | 5 | — | 0 | — | — | — | complete | — | — | 0 |
| | 5 | — | 0 | — | — | — | complete | — | — | 0 |
| 55 | 5 | — | 0 | — | — | — | complete | — | — | 0 |
| | 5 | — | 0 | — | — | — | complete | — | — | 0 |
| 56 | 5 | no collapse | 19 | 3 | 10 | 48 | none | no edge all across | 25 | 18 |
| | 5 | no collapse | 20 | 4 | 12 | 51 | none | no edge | 23 | 16 |
| 57 | 5 | 2 | 0 | 2 | 27 | 80 | fair | 20 | 18 | 23 |
| | 5 | 2 | 0 | 2 | 25 | 75 | fair | 25 | 15 | 28 |
| 58 | 5 | 5 | 2 | 5 | 59 | 104 | poor | 13 | 16 | 16 |
| | 5 | 3 | 5 | 3 | 50 | 98 | fair | 4 | 15 | 14 |
| 59 | 5 | 2 | 12 | 3 | 32 | 80 | poor | no edge all across | 13 | 38 |
| | 5 | 55 sec. | 0 | 4 | 37 | 82 | good | 4 | 18 | 38 |
| 60 | 5 | 4 | 3 | 5 | 16 | 34 | poor | no edge all across | 12 | 17 |
| | 5 | 4 | 4 | 4 | 23 | 38 | poor | no edge all across | 9 | 17 |
| 61 | 5 | 2 | 12 | 2 | 3 | 40 | poor | no edge | 3 | 28 |
| | 5 | 2 | 17 | 1 | 51 | 42 | poor | no edge | 2 | 25 |
| 62 | 5 | 1 | 0 | 5 | 35 | 64 | fair | 6 | 14 | 13 |
| | 5 | 1 | 0 | 7 | 40 | 82 | fair | 2 | 10 | 12 |
| 63 | 5 | 10 sec. | 0 | 4 | 42 | 75 | good | 4 | 12 | 28 |
| | 5 | 10 sec. | 0 | 5 | 49 | 83 | good | 4 | 8 | 26 |
| 64 | 5 | — | 0 | — | — | — | complete | | — | 0 |
| | 5 | — | 0 | — | — | — | complete | — | — | 0 |
| 65 | 5 | 46 secs. | 0 | 2 | 23 | 60 | fair | 21 | 15 | 27 |
| | 5 | 40 secs. | 0 | 4 | 38 | 71 | fair | 7 | 6 patchy | 28 |
| 66 | 5 | 2 | 0 | 2 | 23 | 83 | fair | 11 | 9 | 41 |
| | 5 | 2 | 0 | 3 | 27 | 59 | fair | 9 | 7 | 31 |
| 67 | 5 | 1 | 0 | 2 | 28 | 68 | fair | 13 | 9 | 43 |
| | 5 | 2 | 0 | 2 | 20 | 38 | fair | 7 | 6 | 30 |
| 68 | 5 | 4 | 11 | 5 | 17 | 23 | poor | no edge all across | 6 | 25 |
| | 5 | 4 | 7 | 5 | 10 | 30 | poor | no edge all across | 8 | 24 |
| 69 | 5 | 42 secs. | 0 | 7 | 13 | 95 | good | 3 | 17 | 28 |
| | 5 | 40 secs | 0 | 3 | 26 | 93 | good | 8 | 8 patchy | 26 |
| 70 | 5 | 3 | 0 | 3 | 25 | 78 | fair | 7 | 16 | 21 |
| | 5 | 4 | 0 | 4 | 34 | 71 | fair | 6 | 14 | 23 |
| 71 | 5 | 33 secs | 0 | 4 | 33 | 128 | good | 8 | 12 | 31 |
| | 5 | 52 secs | 0 | 4 | 49 | 64 | good | 6 | 5 patchy | 39 |
| 72 | 5 | 2 | 0 | 2 | 31 | 79 | fair | 12 | 10 | 37 |
| | 5 | 2 | 0 | 3 | 32 | 81 | poor | 23 | 9 | 26 |
| 73 | 5 | 2 | 0 | 2 | 47 | 78 | fair | 12 | 11 | 32 |
| | 5 | 2 | 0 | 3 | 27 | 67 | fair | 7 | 6 | 32 |
| 74 | 5 | 2 | 0 | 3 | 25 | 72 | fair | 7 | 11 | 25 |
| | 5 | 2 | 0 | 3 | 41 | 79 | fair | 7 | 17 | 27 |
| WOOLITE | 5 | — | 28 | — | — | 125 | none | no edge all across | — | 28 |

TABLE IV-continued

| Examples | Application Time (sec) | Collapse (min) | Post-Collapse Foam-Height (min) | Development of blow (min) | Full Blow Time (min) | Lifetime (min) | Penetration | Edge Width (mm) | Full Blow (mm) | Initial Height (mm) |
|---|---|---|---|---|---|---|---|---|---|---|
| | 5 | — | 28 | — | — | 139 | none | no edge all across | — | 28 |

TABLE V

EFFECT OF DIFFERENT SOLVENTS

| EXAMPLE | SOLVENTS N—HEPTANE | N—PENTANE | TCTFE[2] | HEXANE | PCT. SOIL REMOVAL | FLAMMABILITY[3] | FOAM COLLAPSE | FOAM RISE |
|---|---|---|---|---|---|---|---|---|
| 75 | 10% | — | — | — | 21% | 0 | 46 SEC. | YES |
| 76 | — | 10% | — | — | 21% | 3 IN. | NO | NO |
| 77 | — | — | 10% | — | 21% | 0 | 16 SEC. | NO |
| 78 | 5% | 5% | — | — | 23% | 2 IN | 77 SEC. | PART |
| 79 | 5% | — | 5% | — | 23% | 0 | 42 SEC. | NO |
| 80 | — | 5% | 5% | — | 23% | 2 IN. | 43 SEC. | NO |
| 81 | 3.3% | 3.3% | 3.3% | — | 24% | 1.5 IN. | 45 SEC. | PART |
| 82 | 6.7% | 1.65% | 1.65% | — | 23% | 1 IN. | 45 SEC. | YES |
| 83 | 1.65% | 6.7% | 1.65% | — | 28% | 1.5 IN. | 47 SEC. | PART |
| 84 | 1.65% | 1.65% | 6.7% | — | 25% | 1 IN. | 47 SEC. | PART |
| 85 | — | — | — | 15% | 37% | 2 IN. | 40 SEC. | YES |
| WOOLITE[4] | — | — | — | — | 30% | 4 IN. | NO | NO |

[1]Each Example comprises in addition to the solvent: about 0.0–3.0% Hamposyl; 20–12.0% Sipon E.S.; 0.0–8.0% Kasil #1; 5.0–20.0% A-70 propellant; and the remainder, water.
[2]TCTFE: Trichlorotrifluoroethylene.
[3]Flammability tests conducted under "Tower Test" methodology.
[4]Woolite: Trademark of American Home Products Corp.

Cleaning results obtained within the foregoing examples exceeded conventional aerosol foams and were substantially the same as steam extraction for Sanders-Lambert Test. Compared with a commercially available carpet cleaner, WOOLITE, the formulation of this invention clearly outperformed WOOLITE in cleaning results. Costs for the method of this invention were substantially less than for other rotary brush or steam extraction cleaning methods as well. Further, as indicated, no special equipment is needed to practice the method of this invention.

Examples of the invention wherein different solvents are used are shown in TABLE V, above. Note that cleaning results are still superior to that for American Home Products Woolite cleaner in direct comparison tests.

PREFERRED METHOD

In the preferred method of practicing this invention, it has been found desirable to form a first, substantially low viscosity foam, by:

Delivering the solvent/surfactant admixture of the present invention via a hydrocarbon or other propellant, and applying said first foam to a soiled carpet surface, having fibers containing soiling particles;

Collapsing said first foam without abrasion into said fibers and emulsifying said segregating said soiling particles during a controlled residence time phase; and Evaporating the solvent of the solvent/surfactant admixture so as to blow the emulsified soil and surfactant into a second foam, elevating said soiling particles substantially to the surface of said fibers.

The pressurized delivery of solvent/surfactant to the surface of the carpet fibers forms the emulsive phase necessary to build the first foam.

However, it is not entirely understood why this first foam collapses and penetrates into the carpet fibers, thereby emulsifying soiling particles within the fibers. It is postulated that within the foam are hydrophilic and hydrophobic layers which form a micelle to keep the solvents (water and organic) and surfactants emulsified. These hydrophilic/hydrophobic interfaces of the present formulations of the invention apparently break down almost immediately upon being dispensed, causing the collapse of the first foam into the carpet fibers. Unexpectedly, this collapse resulted in thorough penetration of the fibers and promoted emulsification and segregation of soiling particles in the fibers thereby.

Finally, as hereinbefore described, the volatile organic solvent component of the solvent/surfactant admixture volatilizes, causing the admixture to blow into a second foam. This brought about a second, surprising result: the previously emulsified, segregated, soiling particles appeared to have been elevated to substantially the surface of the carpet fibers. After drying, both the soiling materials and the admixture may conveniently be vacuumed up or otherwise removed.

The foregoing examples, embodiments, and descriptions are by way of exemplification, and not intended to limit the scope and equivalents of the invention. Equivalent embodiments which would be apparent to the reasonably skilled practitioner are encompassed within the scope of this invention. For example, other fabrics may be cleaned using the method of this invention. The method may be modified to include a procedure for coating fabrics with waterproof or dirt resistant coatings.

What is claimed is:

1. A method for cleaning soiled fabrics having fibers containing soiling particles, comprising:

(a) forming a first, substantially low viscosity foam by delivering a solvent/surfactant admixture via a liquefiable propellant, said solvent being an organic volatile solvent with a consistent evaporation rate and a vapor pressure of 760 mm of mercury at a temperature of no greater than 175° C., said surfactant selected from the group consisting of anionic, cationic, nonionic, amphoteric surfactants, and mixtures thereof, said solvent being present at about 0.5% to 20.0% by weight, said surfactant being present at about 0.1% to 30.0% by weight, and said propellant being present at about 10.0% to 50.0% by weight;

(b) applying said first foam to a soiled carpet surface having fibers containing soiling particles;

(c) allowing said first foam to collapse without abrasion into said fibers and emulsifying and segregating said soiling particles during a controlled residence time; and (d) allowing said solvent of the solvent/surfactant admixture to form a second foam, thereby elevating said soiling particles substantially to the surface of said fibers.

2. The method of claim 1 wherein said solvent is selected from the group consisting essentially of saturated, substituted, or halogenated alkane of 1 to 12 carbon atoms, and mixtures thereof.

3. The method of claim 1 wherein said surfactant is an anionic surfactant selected from the group consisting essentially of alkali metal salts of (a) alkyl, or alkylaryl sulfates;

(b) alkyl, or alkylaryl sulfonates;

(c) alkyl, or alkylaryl sarcosinates; and mixtures thereof.

4. The method of claim 1 wherein said propellant is a compressible propellant selected from the group of saturated hydrocarbons consisting of methane, ethane, iso-propane, n-propane, iso-butane, n-butane, pentane, hexane, heptane, octane, nonane, decane, dodecane, and mixtures thereof.

5. The method of claim 1 wherein in step (a), said solvent/surfactant admixture includes a builder selected from the group consisting of alkali metal salts of silicates, phosphates, and carbonates.

6. The method of claim 5 wherein in step (a), said surfactant/solvent admixture further comprises:

about 0.0% to 20.0% by weight of said builder; and the remainder water.

7. A dispensing means which comprises:

a closed container, propellant and solvent/surfactant admixture-containing chamber and dispensing head;

said dispensing means containing an aqueous solvent-/surfactant admixture, said solvent being a volatile organic solvent having a consistent evaporation rate in ambient air and having a vapor pressure of 760 mm of mercury at a temperature of no greater than 175° C., and said surfactant being foam-forming and selected from the group consisting essentially of anionic, cationic, nonionic, amphoteric surfactants and mixtures thereof, said admixture being propelled by a liquefiable propellant, said solvent being present at about 0.5% to 20.0% be weight, said surfactant being present at about 0.1% to 30.0% by weight, and said propellant being present at about 10.0% to 50.0% by weight;

said dispensing means delivering under pressure said solvent/surfactant admixture onto a fabric surface, whereupon said solvent/surfactant admixture foams an initial foam, then collapses without abrasion during a controlled residence time; and said solvent in said mixture thereafter evaporating, causing a second foam to form and rise through said fabric surface.

8. The dispensing means of claim 7 wherein said solvent is selected from the group consisting essentially of saturated, substituted, or halogenated alkane of 1 to 12 carbon atoms, and mixtures thereof.

9. The dispensing means of claim 7 wherein said surfactant is an anionic surfactant selected from the group consisting essentially of alkali metal salts of (a) alkyl, or alkylaryl sulfates;

(b) alkyl, or alkylaryl sulfonates;

(c) alkyl, or alkylaryl sarcosinates; and mixtures thereof.

10. The dispensing means of of claim 7 wherein said propellant is a compressible propellant selected from the group of saturated hydrocarbons consisting of methane, ethane, iso-propane, n-propane, iso-butane, n-butane, pentane, hexane, heptane, octane, nonane, decane, dodecane, and mixtures thereof.

11. The dispensing means of claim 7 wherein said solvent/surfactant admixture includes a builder selected from the group consisting essentially of alkali metal salts of silicates, phosphates, and carbonates.

12. The dispensing means of claim 11 wherein said surfactant/solvent admixture further comprises:

about 0.0% to 20.0% by weight of said builder; and the remainder as water.

* * * * *